US012421710B2

(12) United States Patent
Fleming

(10) Patent No.: US 12,421,710 B2
(45) Date of Patent: Sep. 23, 2025

(54) BEAVER CONTROL DEVICE FOR A CULVERT

(71) Applicant: Walter Fleming, Fort Erie (CA)

(72) Inventor: Walter Fleming, Fort Erie (CA)

( * ) Notice: Subject to any disclaimer, the term of this patent is extended or adjusted under 35 U.S.C. 154(b) by 195 days.

(21) Appl. No.: 18/454,314

(22) Filed: Aug. 23, 2023

(65) Prior Publication Data

US 2025/0034856 A1 Jan. 30, 2025

(30) Foreign Application Priority Data

Jul. 28, 2023 (CA) ..... CA 3207830

(51) Int. Cl.
*E03F 7/06* (2006.01)

(52) U.S. Cl.
CPC ..... *E03F 7/06* (2013.01)

(58) Field of Classification Search
CPC ... E03F 7/06; E01F 5/005; F16L 55/24; F16L 57/005; A01M 29/30
See application file for complete search history.

(56) References Cited

U.S. PATENT DOCUMENTS 961,834 A * 6/1910 Berlett ..... E03F 7/06 210/446
2,488,466 A * 11/1949 Carver ..... A01M 23/04 114/221 R
4,713,179 A * 12/1987 Goedderz, Sr. ..... E03F 7/06 210/162
5,037,542 A * 8/1991 Carroll ..... E01F 5/005 210/170.03
5,102,537 A * 4/1992 Jones ..... E03F 7/06 210/162
8,845,405 B2 * 9/2014 Greenberg ..... F24F 13/082 454/367
9,303,397 B1 * 4/2016 Fleming ..... F16L 55/24
9,422,693 B2 * 8/2016 Johnston ..... A01M 29/30
2004/0010962 A1 * 1/2004 Chevalier ..... E01F 5/005 43/101
2007/0059101 A1 * 3/2007 Fleming ..... E03F 7/06 210/162
2007/0154266 A1 * 7/2007 Wassman ..... E01F 5/005 405/125
2009/0279954 A1 * 11/2009 Griffith ..... E03F 7/06 405/125
2018/0304177 A1 * 10/2018 Kent ..... B01D 33/0166

FOREIGN PATENT DOCUMENTS

CA 2375006 A1 * 9/2003 ..... E01F 5/005

* cited by examiner

*Primary Examiner* — Benjamin F Fiorello
(74) *Attorney, Agent, or Firm* — Adrian D. Battison; Ade & Company Inc.; Ryan W. Dupuis

(57) ABSTRACT

A culvert has an attachment at an entrance end for inhibiting beaver activity at the culvert where the attachment includes two panels coupled together at one end by a third panel portion or by a hinge to form a pivotal structure with each panel including a bottom rail placed on a ground surface extending from the culvert entrance and a plurality of upstanding bars at spaced positions along the bottom rail. The attachment is opened at the hinge line or the third panel portion so that the hinge line is located in front of the entrance with each panel extending back to a respective side of the entrance and fastened by a chain coupling to that side. The upstanding bars are arranged so that water passes therebetween to or from the entrance end and the bars are closely spaced so as to prevent passage of beavers to the entrance end.

19 Claims, 6 Drawing Sheets

FIG. 5
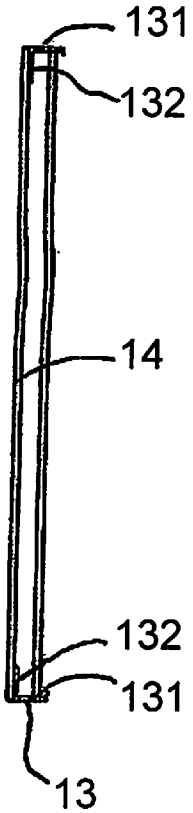
FIG. 4
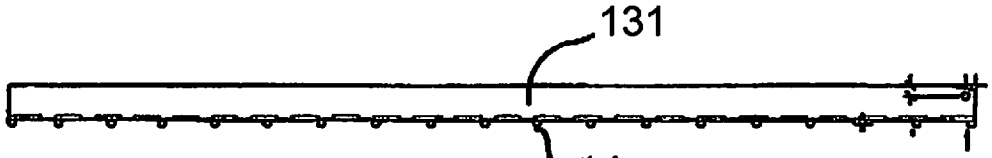
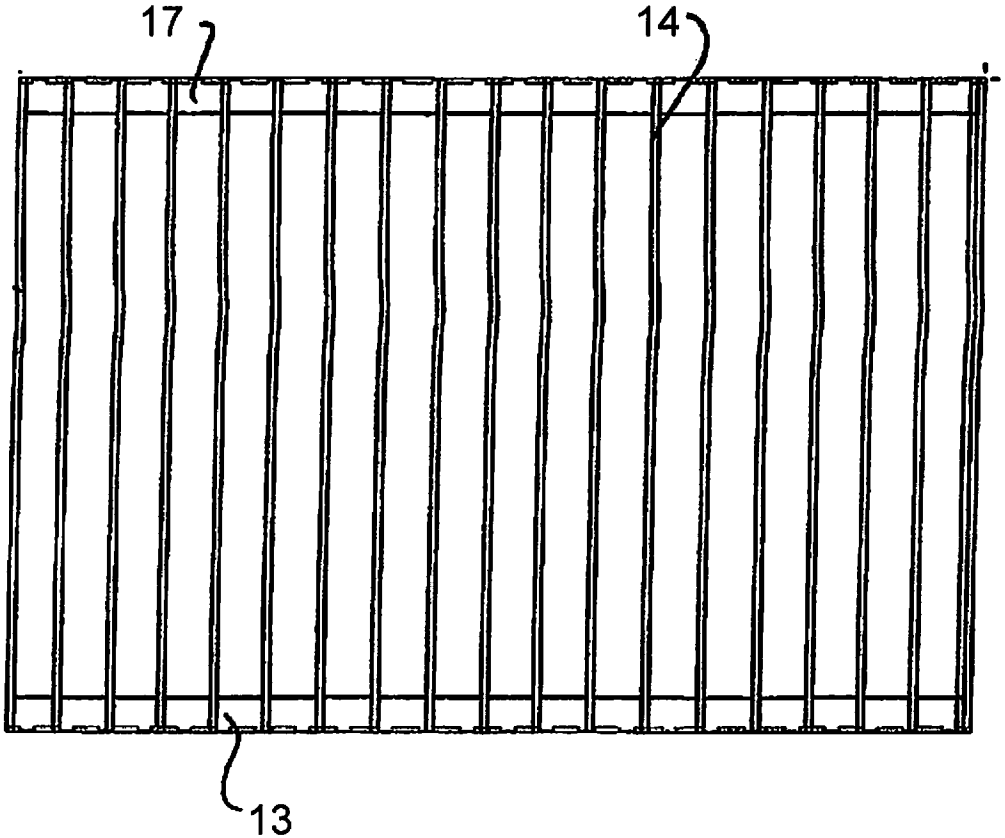
FIG. 3

BEAVER CONTROL DEVICE FOR A CULVERT

This invention relates generally to a device for attachment to an end of a culvert for preventing beavers from building a dam to block the flow of water.

BACKGROUND OF THE INVENTION

Culvert pipes are widely used to allow water to flow beneath roads without having to redirect it or construct a bridge to pass over the stream. Unfortunately, such pipes represent an ideal place for beavers to construct a damn and restrict the flow of water. These damns can quickly cause flooding and washouts when water levels are elevated, for example, by heavy rains or melting snow. Vertical screens or grates have been used to prevent beavers from entering culverts, but such devices do not discourage beavers from building dams at the ends of a culvert pipe. Also, water flows tend to deposit debris at such barriers which builds up over time and restricts flow through the culvert.

U.S. Pat. No. 7,441,989 by the present inventor discloses a cone-shaped screen that is intended to overcome the limitations of the flat designs discussed above. A base end of the screen attached to the end of the culvert has a series of rods extending outward from the culvert to an apex end. The rods are spaced by a distance that allows small debris to pass through without clogging the culvert while preventing entry by beavers and similarly sized animals. The beavers cannot construct an ideal damn at the opening of the culvert as they cannot properly anchor the structure.

Another arrangement by the present inventor is proposed in U.S. Pat. No. 9,303,397 which provides a generally tubular frame construction formed of welded bars with a plurality of transverse bars generally parallel to a transverse center plane of the frame where each of the transverse bars spans substantially straight across the frame and where the transverse bars are elevated above a bottom peripheral portion of the frame and located at a position below the transverse center plane so that the transverse bars are closer to the bottom peripheral portion than to the top peripheral portion. The raised bars interfere with the beavers moving along the frame so as to interfere with their activities.

As a result of limiting access to the culvert by beavers, the prior art also limits access to the culvert pipe by others. Large culverts require correspondingly large screens that are difficult and costly to transport due to their dimensions. As a result, there is a desire for a beaver control device that is easy to transport and prevents dam construction and debris buildup at the end of a culvert pipe.

SUMMARY OF THE INVENTION

According to the invention there is provided a culvert apparatus for use with a culvert having an entrance end for inhibiting beaver activity at the culvert, the apparatus comprising:

an attachment for the culvert at the entrance end comprising:

a first panel having a bottom rail for placement on a ground surface and a plurality of upstanding bars at spaced positions along the bottom rail;

a second panel having a bottom rail for placement on a ground surface and a plurality of upstanding bars at spaced positions along the bottom rail;

the upstanding bars of each of the first and second panels being arranged so that water can pass therebetween to or from the entrance end and spaced so as to prevent passage of beavers to the entrance end;

the first and second panels being connected by a connecting member at one end for pivotal movement about an upstanding axis.

and first and second flexible coupling elements arranged to extend from each respective panel to the culvert at or adjacent the entrance end to hold the attachment in fixed position in front of the entrance end;

wherein the attachment is open between the panels at the top of the panels so as to allow passage of water to the entrance end over the top of the panels.

According to a second aspect of the invention there is provided a culvert apparatus for inhibiting beaver activity comprising:

a culvert having an entrance end;

an attachment mounted on the culvert at the entrance end consisting of:

a first panel having a bottom rail placed on a ground surface extending from the culvert entrance and a plurality of upstanding bars at spaced positions along the bottom rail;

a second panel having a bottom rail placed on a ground surface extending from the culvert entrance and a plurality of upstanding bars at spaced positions along the bottom rail;

the upstanding bars of each of the first and second panels being arranged so that water passes therebetween to or from the entrance end and spaced so as to prevent passage of beavers to the entrance end;

the first and second panels being connected at a hinge at one end for pivotal movement about an upstanding axis so that the panels are moved from an overlying position to a V-shape with an apex of the V-shape at the connected ends;

the panels having a length so that each extends from the hinge rearwardly and outwardly from the hinge to an end of the panel opposite the hinge to respected sides of the entrance end;

and first and second flexible coupling elements extending from each respective panel to the culvert at or adjacent the entrance end on a respective side of a center line to hold the attachment in fixed position in front of the entrance end;

wherein the attachment is open between the panels at the top of the panels so as to allow passage of water to the entrance end over the top of the panels.

According to a third aspect of the invention there is provided a culvert apparatus for inhibiting beaver activity comprising:

culvert apparatus for inhibiting beaver activity comprising:

a culvert defined by a cylindrical shape which may be circular or arched to form a top of the cylindrical shape, two sides and a bottom, the culvert having an entrance end where the entrance end is bevelled to form a bevel cut where the sides of the culvert are cut downwardly from a top of the culvert toward an outer end of the bevel cut at the bottom of the cylindrical shape;

an attachment mounted on the culvert at the entrance end consisting of:

a first panel having a bottom rail placed on a ground surface extending from the culvert entrance and a plurality of upstanding bars at spaced positions along the bottom rail;

a second panel having a bottom rail placed on a ground surface extending from the culvert entrance and a plurality of upstanding bars at spaced positions along the bottom rail;

the upstanding bars of each of the first and second panels being arranged so that water passes therebetween to or from the entrance end and spaced so as to prevent passage of beavers to the entrance end;

the first and second panels being connected by a third panel portion hingedly connected at respective ends to each of the first and second panels at one end for pivotal movement about an upstanding axis so that the first and second panels are moved from an overlying position to a generally rectangular shape with the third panel portion at or adjacent the outer end of the bevel cut;

the panels having a length so that each extends from the third panel portion at the outer end of the bevel cut rearwardly from the outer end to an end of the panel opposite the outer end to respected sides of the entrance end;

and first and second flexible coupling elements extending from each respective panel to the culvert at or adjacent the entrance end on a respective side of a center line to hold the attachment in fixed position in front of the entrance end;

wherein the attachment is open between the panels at the top of the panels so as to allow passage of water to the entrance end over the top of the panels.

Preferably the panels are rectangular with the third panel portion being substantially of the same height as the first and second panels.

Preferably the third panel portion has a width substantially equal to that of the culvert so that the first and second panels lie along the sides of the cut bevel. Preferably each panel has a top rail connecting the upstanding bars.

Preferably the panels are rectangular so that the top rail is parallel to the bottom rail on the ground, but other chapes are possible with the top rail inclined to the ground so that one end is higher than the other end.

Preferably the rails are formed from an angle with two flanges at right angles. However other rail cross-sections can be used including tubular Preferably the bars are welded to an outer surface of an upstanding outer flange of the angle.

Preferably the angle provides a horizontal flange to form a top or bottom of the panel. In this way the horizontal flanges are available for the hinge to be formed by a coupling pin passing through the horizontal flanges.

Preferably the coupling elements are relatively short and each arranged to extend from the end of the respective panel to a connector on the culvert at a position spaced outwardly of a center line of the culvert. This holds each panel in place at the respective side with the hinge axis on a center line of the culvert.

Preferably the attachment is open between the panels both at the top of the panels and at the bottom of the panels so as to allow passage of water to the entrance end over the top of the panels. In this way the apparatus can be compressed for transport with one panel lying directly on top of the other and then the angle at the hinge opened to place the attachment in the operating position.

The attachment herein can be used with different constructions of culvert made of different materials including coiled steel, concrete and plastic where the cross-section of the culvert can be circular, elliptical or arched.

BRIEF DESCRIPTION OF THE DRAWINGS

FIG. 3 is a front elevational view of one panel of the apparatus of FIG. 1.

FIG. 4 is a top plan view of one panel of the apparatus of FIG. 1.

FIG. 5 is an end elevational view of one panel of the apparatus of FIG. 1.

DETAILED DESCRIPTION

Figure 1:
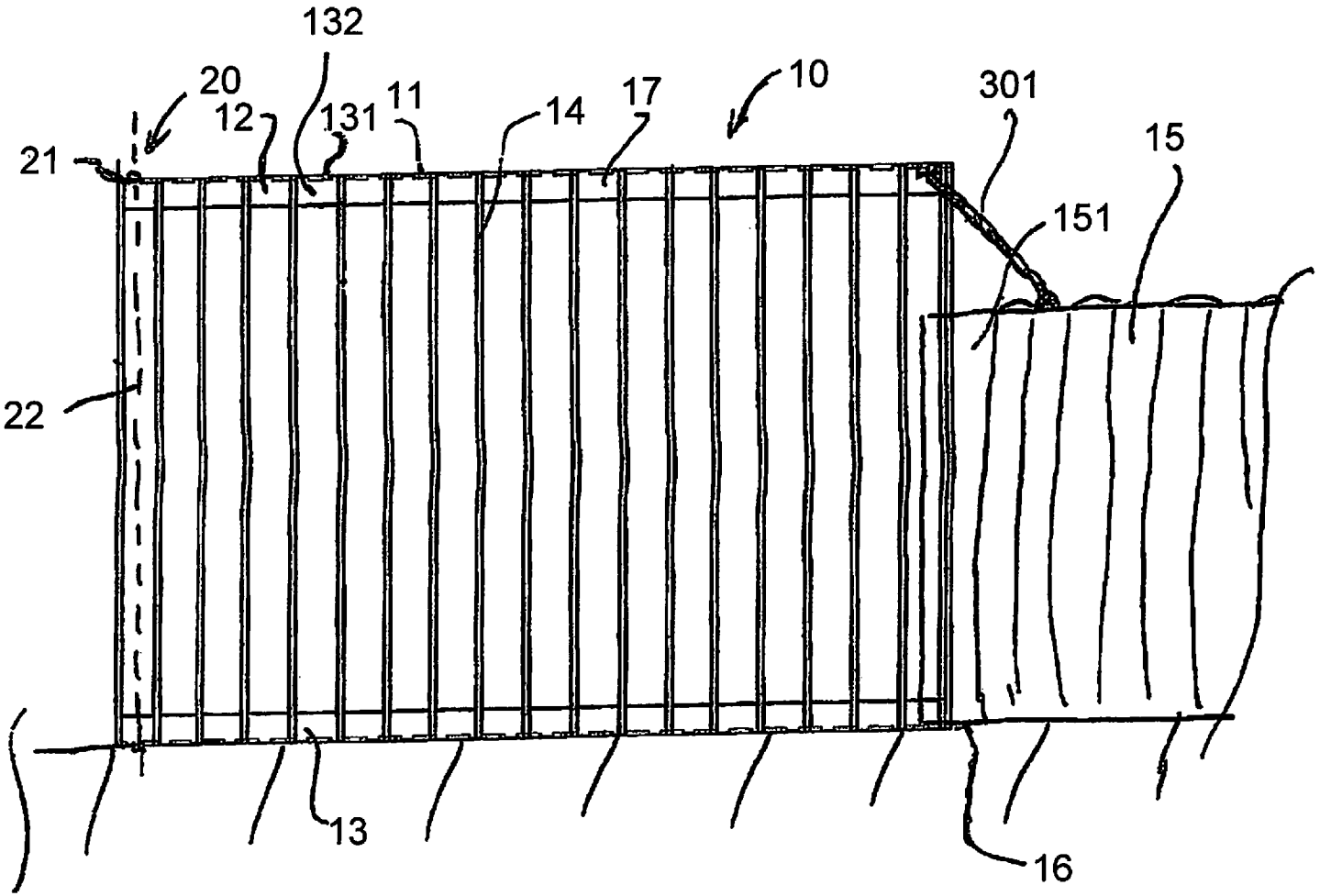
FIG. 1 is a side elevational view of a culvert apparatus according to the present invention.

A culvert apparatus 10 shown in FIGS. 1 to 5 for inhibiting beaver activity at a culvert 15 having a circular entrance end 151 includes an attachment 11 for the culvert 10 at the entrance end 151. The attachment has first and second panels 12 and 121 each having a bottom rail 13 for placement on a ground surface 16 where the ground surface is excavated to form a flat surface extending away from the entrance end. Each panel has a top rail 17 and a plurality of upstanding bars 14 connecting the top and bottom rails and at spaced positions along the panel.

The upstanding bars 14 of the panels are formed from metal rod so as to be welded to the rails. The bars are spaced by a distance of the order of 6 inches so that water can readily pass therebetween to or from the entrance end so as to prevent passage of beavers to the entrance end.

The rails 13 and 17 are formed from an angle iron with two flanges 131 and 132 at right angles with the flange 131 horizontal and the flange 132 vertical. The bars 14 are welded to an outer surface of an upstanding outer flange 132 of the angle as best shown in FIG. 5. The horizontal flange 131 forms a top or bottom of the respective panel.

Figure 2:
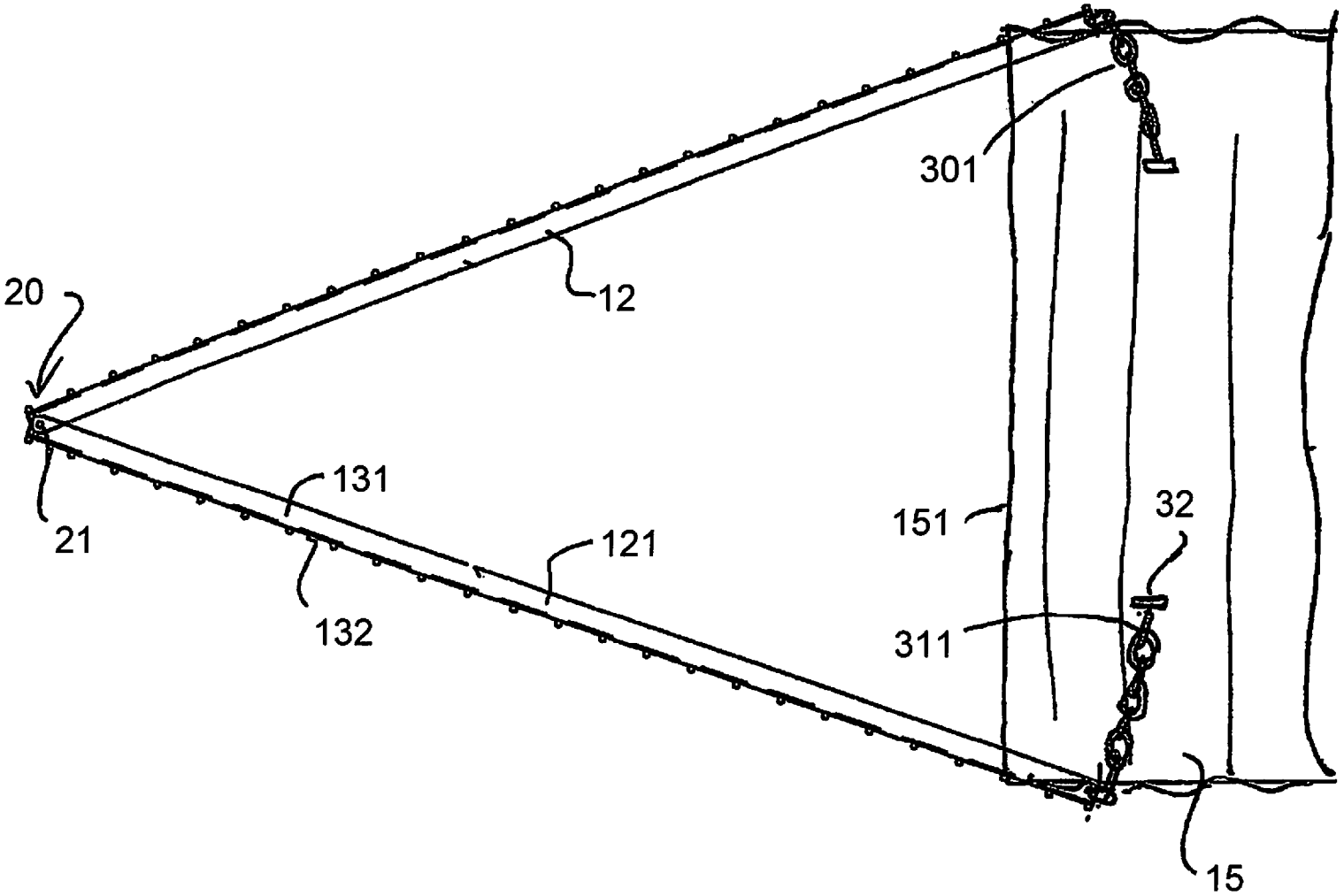
FIG. 2 is a top plan view of the culvert apparatus of FIG. 1.

The first and second panels as best shown in FIG. 2 are connected at a hinge 20 by pins 21 at one end for pivotal movement about an upstanding axis 22 so that the panels can be moved from an overlying position (not shown) to a V-shape as shown in FIG. 2 with an apex of the V-shape defined by the hinge 20 at the connected ends.

The hinge is formed by coupling pins 21 passing through the horizontal flanges 131 where those flanges overlap at the hinge end.

The panels having a length so that each extends from the hinge 20 rearwardly and outwardly from the hinge to an end of the panel opposite the hinge to respected sides of the entrance end 151;

The panels include first and second flexible coupling elements 301, 311 in the form of chains or other flexible straps which extend from each respective panel to the culvert 15 at or adjacent the entrance end 151 to hold the attachment in fixed position in front of the entrance end. The chains 301, 311 are relatively short to that they extend from the end of the panel where the inner face of the panel abuts the end of the culvert to locate the panel at the culvert inwardly to a fastener 32 on the culvert. The chain can be welded to the panel and looped through a suitable loop or other fastener at the culvert. The attachment method is therefore very simple and very quick but holds the structure in place against any forces from water movement or animals as the bottom rail sits on the ground, as the triangular shape locates the panels against aide to side movement and the coupling 301 and 311 hold the panels against movement away from the culvert.

The attachment is defined simply by the two panels so that the attachment is open between the panels both at the top of the panels and at the bottom of the panels so as to allow passage of water to the entrance end over the top of the panels.

Figure 6:
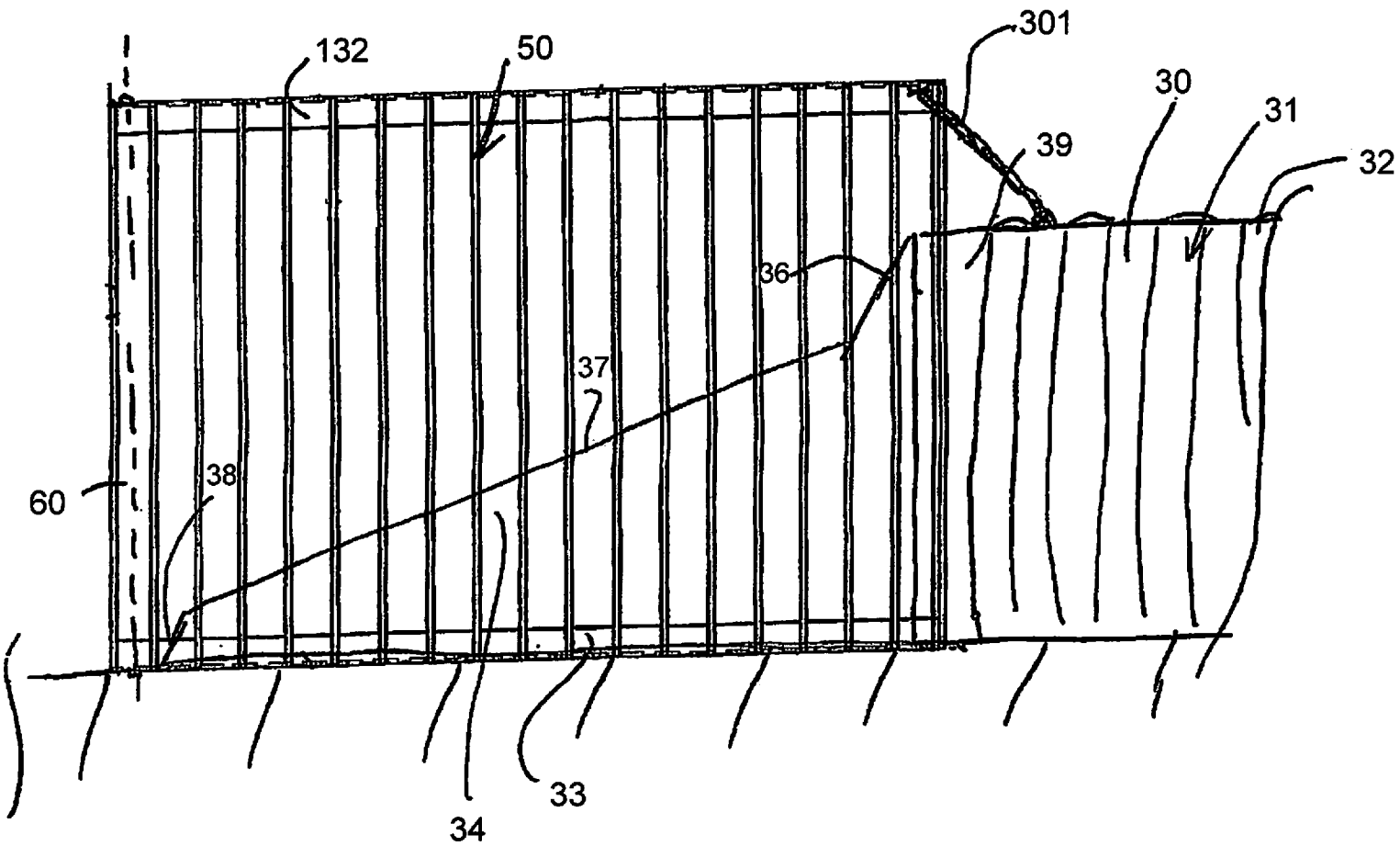
FIG. 6 is a side elevational view of a second embodiment of culvert apparatus according to the present invention where the culvert is of the type known as a bevel cut culvert.
Figure 7:
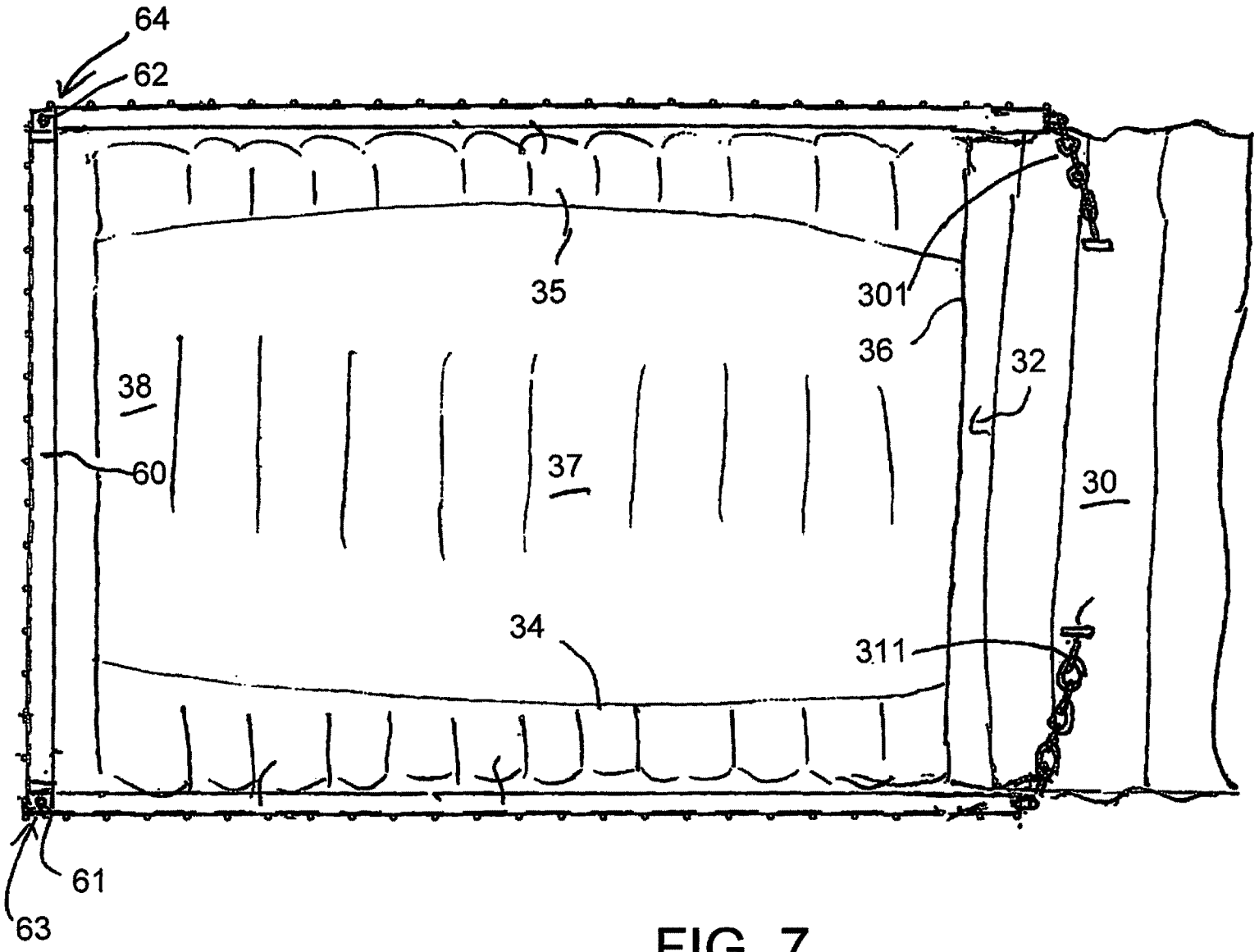
FIG. 7 is a top plan view of the culvert apparatus of FIG. 6.
Figure 8:
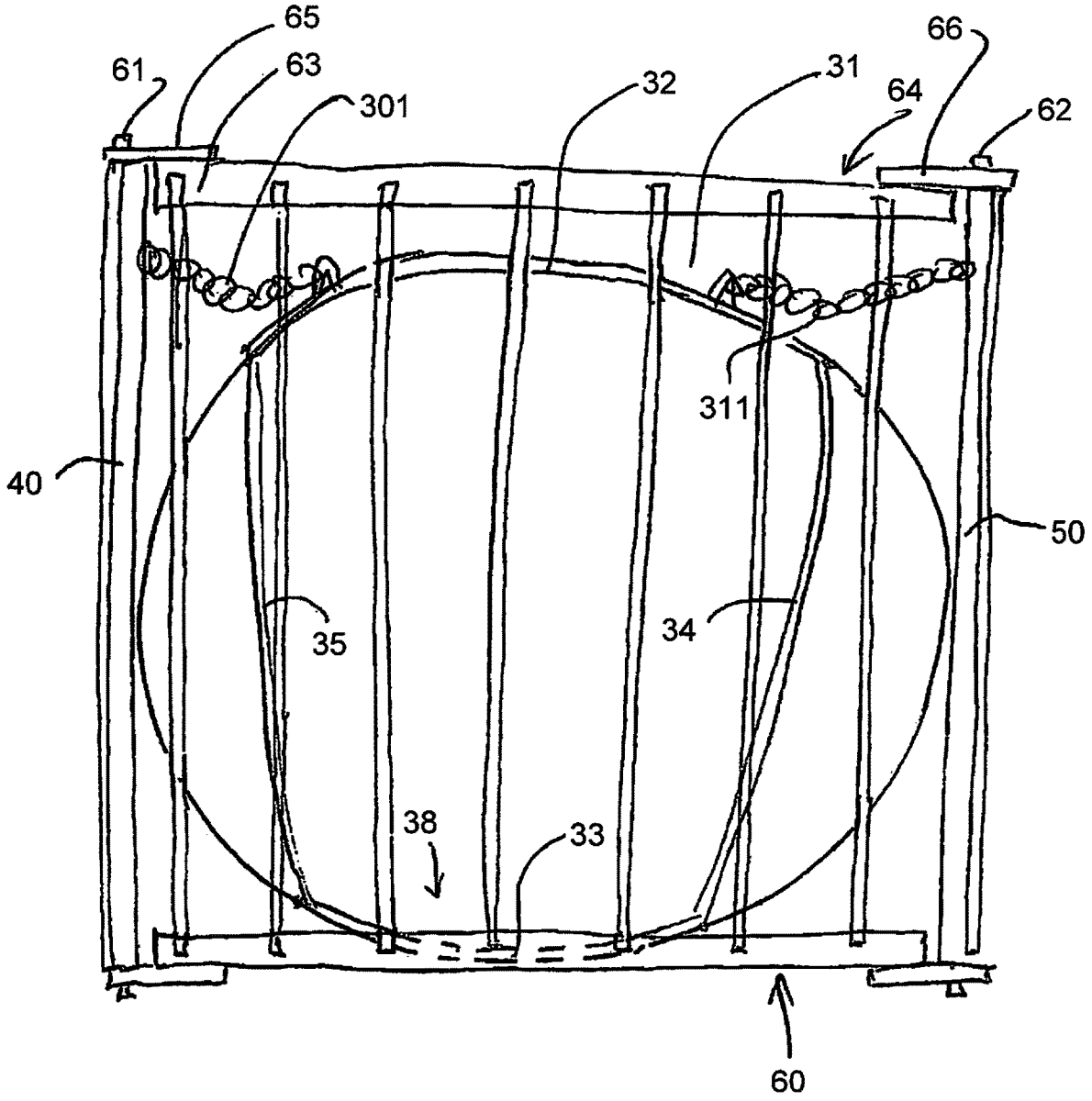
FIG. 8 is a front elevational view of the apparatus of FIG. 6.

Turning now to FIGS. 6, 7 and 8 there is shown a culvert apparatus for inhibiting beaver activity where the culvert 30 is defined by a cylindrical shape 31 which may be circular or arched to form a top 32 of the cylindrical shape, two sides 34 and 35 and a bottom 33. This is formed as best shown in FIG. 6 by cutting the sides of the end edge of the culvert to form a first cut down portion 36, angled downwardly sharply and then a second cut down portion 37 which is inclined gradually downwardly to a short bottom portion 38. This shape of culvert is well known and widely used in some jurisdictions as it is believed to provide a better water flow into the entrance mouth of the culvert than can be achieved by the transverse radial cut of the embodiment of FIG. 1.

The culvert thus has an entrance end where the entrance end commences at the radial cut end 39 is bevelled to form a bevel cut where the sides of the culvert are cut downwardly from a top of the culvert toward an outer end of the bevel cut at the bottom of the cylindrical shape. This forms a cut edge of the culvert material part of which is at the circular radial entrance, and part of which is inclined downwardly the stub portion at the bottom end remote from the circular radial entrance.

In this embodiment, the apparatus includes an attachment mounted on the culvert at the entrance end which includes a first panel 40 and a second panel 50 which are constructed as defined above in the first embodiment and thus have a bottom rail placed on a ground surface extending from the culvert entrance and a plurality of upstanding bars at spaced positions along the bottom rail.

Thus as before the upstanding bars of each of the first and second panels are arranged so that water passes therebetween to or from the entrance end and spaced so as to prevent passage of beavers to the entrance end.

In this embodiment the first and second panels 40, 50 are connected by a third panel portion 60 hingedly connected at respective ends 63 and 64 by pivot pins 61, 62 to each of the first and second panels at one end for pivotal movement about an upstanding axis. The pins 61 and 62 are mounted in flanges 65 and 66 attached to the ends of the third panel portion and engage into holes in the respective panel 40, 50. In this way the three panels are free to pivot one relative to the other so that the first and second panels can moved from an overlying position for storage and transfer to a generally rectangular shape with the third panel portion at right angles to the first and second. In operation the third panel portion is located at or adjacent the outer end 38 of the bevel cut at the end butt portion of the culvert bevel cut.

The panels 40 and 50 having a length so that each extends from the third panel portion 60 at the outer end of the bevel cut rearwardly from the outer end to an end of the panel opposite the outer end to respected sides of the entrance end 32. First and second flexible coupling elements 301 and 311 as previously described extend from each respective panel 40, 50 to the culvert at or adjacent the entrance end 32 on a respective side of a center line to hold the attachment in fixed position in front of the entrance end as previously described As described above, the panels have a height typically greater than that of the culvert and have a common height so that the top rails are coplanar but this is not essential and different heights can be used. the attachment is open between the panels at the top of the panels so as to allow passage of water to the entrance end over the top of the panels.

As shown in FIG. 8 the third panel portion has a width substantially equal to that of the culvert so that the first and second panels lie along the sides of the cut bevel thus forming the structure into a rectangle.

The invention claimed is:

1. A culvert apparatus for use with a culvert having an entrance end for inhibiting beaver activity at the culvert, the apparatus comprising:

an attachment for the culvert at the entrance end comprising:

a first panel having a bottom rail for placement on a ground surface and a plurality of upstanding bars at spaced positions along the bottom rail;

a second panel having a bottom rail for placement on a ground surface and a plurality of upstanding bars at spaced positions along the bottom rail;

the upstanding bars of each of the first and second panels being arranged so that water can pass therebetween to or from the entrance end and spaced so as to prevent passage of beavers to the entrance end;

the first and second panels being connected by a connecting member at one end for pivotal movement about an upstanding axis;

and first and second flexible coupling elements arranged to extend from each respective panel to the culvert at or adjacent the entrance end to hold the attachment in fixed position in front of the entrance end;

wherein the attachment is open between the panels at the top of the panels so as to allow passage of water to the entrance end over the top of the panels.

2. The culvert apparatus according to claim 1 wherein each panel has a top rail connecting the upstanding bars.

3. The culvert apparatus according to claim 1 wherein the panels are rectangular.

4. The culvert apparatus according to claim 1 wherein the rails are formed from an angle with two flanges at right angles.

5. The culvert apparatus according to claim 4 wherein the bars are welded to an outer surface of an upstanding outer flange of the angle.

6. The culvert apparatus according to claim 4 wherein the angle provides a horizontal flange to form a top or bottom of the panel.

7. The culvert apparatus according to claim 1 wherein the connecting member comprises a hinge which is formed by a coupling pin passing through the horizontal flanges.

8. The culvert apparatus according to claim 1 wherein the coupling elements are each arranged to extend from the end of the respective panel to a connector on the culvert at a position spaced outwardly of a center line of the culvert.

9. The culvert apparatus according to claim 1 wherein the connecting member comprises a hinge so that the panels can be moved from an overlying position to a V-shape with an apex of the V-shape at the connected ends and wherein the panels having a length so that each can extend from the hinge rearwardly and outwardly from the hinge to an end of the panel opposite the hinge to respected sides of the entrance end.

10. The culvert apparatus according to claim 1 wherein the connecting member comprises a third panel portion hingedly connected at respective ends to each of the first and second panels and wherein the first and second panels having a length so that each can extend from the third panel portion rearwardly from the third panel portion to an end of the panel opposite the third panel portion to respected sides of the entrance end.

11. A culvert apparatus for inhibiting beaver activity comprising:

a culvert having an entrance end;

an attachment mounted on the culvert at the entrance end consisting of:

a first panel having a bottom rail placed on a ground surface extending from the culvert entrance and a plurality of upstanding bars at spaced positions along the bottom rail;

a second panel having a bottom rail placed on a ground surface extending from the culvert entrance and a plurality of upstanding bars at spaced positions along the bottom rail;

the upstanding bars of each of the first and second panels being arranged so that water passes therebetween to or from the entrance end and spaced so as to prevent passage of beavers to the entrance end;

the first and second panels being connected at a hinge at one end for pivotal movement about an upstanding axis so that the panels are moved from an overlying position to a V-shape with an apex of the V-shape at the connected ends;

the panels having a length so that each extends from the hinge rearwardly and outwardly from the hinge to an end of the panel opposite the hinge to respected sides of the entrance end;

and first and second flexible coupling elements extending from each respective panel to the culvert at or adjacent the entrance end on a respective side of a center line to hold the attachment in fixed position in front of the entrance end;

wherein the attachment is open between the panels at the top of the panels so as to allow passage of water to the entrance end over the top of the panels.

12. The culvert apparatus according to claim 11 wherein each panel has a top rail connecting the upstanding bars.

13. The culvert apparatus according to claim 11 wherein the panels are rectangular and of the same height.

14. The culvert apparatus according to claim 11 wherein the coupling elements are each arranged to extend from the end of the respective panel to a connector on the culvert at a position spaced outwardly of a center line of the culvert.

15. A culvert apparatus for inhibiting beaver activity comprising:

a culvert defined by a cylindrical shape which may be circular or arched to form a top of the cylindrical shape, two sides and a bottom, the culvert having an entrance end where the entrance end is bevelled to form a bevel cut where the sides of the culvert are cut downwardly from a top of the culvert toward an outer end of the bevel cut at the bottom of the cylindrical shape;

an attachment mounted on the culvert at the entrance end consisting of:

a first panel having a bottom rail placed on a ground surface extending from the culvert entrance and a plurality of upstanding bars at spaced positions along the bottom rail;

a second panel having a bottom rail placed on a ground surface extending from the culvert entrance and a plurality of upstanding bars at spaced positions along the bottom rail;

the upstanding bars of each of the first and second panels being arranged so that water passes therebetween to or from the entrance end and spaced so as to prevent passage of beavers to the entrance end;

the first and second panels being connected by a third panel portion hingedly connected at respective ends to each of the first and second panels at one end for pivotal movement about an upstanding axis so that the first and second panels are moved from an overlying position to a generally rectangular shape with the third panel portion at or adjacent the outer end of the bevel cut;

the panels having a length so that each extends from the third panel portion at the outer end of the bevel cut rearwardly from the outer end to an end of the panel opposite the outer end to respected sides of the entrance end;

and first and second flexible coupling elements extending from each respective panel to the culvert at or adjacent the entrance end on a respective side of a center line to hold the attachment in fixed position in front of the entrance end;

wherein the attachment is open between the panels at the top of the panels so as to allow passage of water to the entrance end over the top of the panels.

16. The culvert apparatus according to claim 15 wherein each panel has a top rail connecting the upstanding bars.

17. The culvert apparatus according to claim 15 wherein the panels are rectangular with the third panel portion being substantially of the same height as the first and second panels.

18. The culvert apparatus according to claim 15 wherein the coupling elements are each arranged to extend from the end of the respective panel to a connector on the culvert at a position spaced outwardly of a center line of the culvert.

19. The culvert apparatus according to claim 15 wherein the third panel portion has a width substantially equal to that of the culvert so that the first and second panels lie along the sides of the cut bevel.

* * * * *